US006461102B2

(12) United States Patent
Sting et al.

(10) Patent No.: US 6,461,102 B2
(45) Date of Patent: Oct. 8, 2002

(54) CHARGING APPARATUS

(75) Inventors: Martin Sting, Frankfurt; Stefan Will, Biebertal, both of (DE)

(73) Assignee: Pitney Bowes Technologies GmbH, Friedberg (DE)

( * ) Notice: Subject to any disclaimer, the term of this patent is extended or adjusted under 35 U.S.C. 154(b) by 0 days.

(21) Appl. No.: 09/400,426

(22) Filed: Sep. 21, 1999

(65) Prior Publication Data

US 2002/0094266 A1 Jul. 18, 2002

(51) Int. Cl.[7] ..... B65G 59/00

(52) U.S. Cl. ..... 414/798.9; 414/796.5; 414/788.1; 414/788.8; 414/917; 271/35; 271/31.1; 271/110

(58) Field of Search ..... 414/798.9, 796.5, 414/917, 788.1, 788.8; 271/35, 110, 31.1, 150, 151

(56) References Cited

U.S. PATENT DOCUMENTS

| | | | | | |
|---|---|---|---|---|---|
| 3,664,660 | A | | 5/1972 | Runzi | |
| 3,780,881 | A | | 12/1973 | Friel | |
| 4,049,258 | A | * | 9/1977 | Zeblisky | 271/151 |
| 4,049,259 | A | * | 9/1977 | Ventz | 271/151 |
| 4,240,539 | A | * | 12/1980 | Klapp | 198/461 |
| 4,366,955 | A | | 1/1983 | Pessina et al. | 271/7 |
| 4,673,175 | A | | 6/1987 | Morita | 271/10 |
| 4,809,964 | A | | 3/1989 | Wood | 270/58 |
| 4,832,179 | A | * | 5/1989 | Simmons | 198/461 |
| 4,930,764 | A | | 6/1990 | Holbrook et al. | 271/2 |
| 4,973,037 | A | | 11/1990 | Holbrook | 271/2 |
| 4,978,114 | A | | 12/1990 | Holbrook | 271/35 |
| 5,088,718 | A | | 2/1992 | Stepan et al. | 271/161 |
| 5,131,899 | A | * | 7/1992 | Nagahashi et al. | 271/31.1 |
| 5,154,408 | A | | 10/1992 | Stepan et al. | 271/121 |
| 5,161,792 | A | | 11/1992 | Wood | 271/151 |
| 5,192,069 | A | | 3/1993 | Seymour et al. | 271/35 |
| 5,211,529 | A | * | 5/1993 | Esala et al. | 414/795.8 |
| 5,249,788 | A | | 10/1993 | Helmstadter | 271/10 |
| 5,308,052 | A | * | 5/1994 | Roch et al. | 271/31.1 |
| 5,413,323 | A | * | 5/1995 | Imbert et al. | 271/149 |
| 5,508,818 | A | | 4/1996 | Hamma | 358/403 |
| 5,601,282 | A | | 2/1997 | Milo et al. | 271/35 |
| 5,775,871 | A | * | 7/1998 | Reddon | 414/798.9 |
| 5,971,389 | A | | 10/1999 | Golicz et al. | 271/34 |

* cited by examiner

*Primary Examiner*—Joseph A. Fischetti
(74) *Attorney, Agent, or Firm*—Michael J. Cummings; Angelo N. Chaclas

(57) ABSTRACT

A charging apparatus for handling stations for sheet-like, flexible articles, in particular envelopes, particularly for mail-processing machines, the drive in a feed-channel for stacks of articles standing on edge being controlled in dependence on a detector output signal produced by a light barrier, which responds to the formation of a gap and runs transversely to the conveying direction with the gap forming in the region of a transition between the feed channel and a discharge channel.

8 Claims, 2 Drawing Sheets

CHARGING APPARATUS

FIELD OF THE INVENTION

The invention relates to a charging apparatus for supplying sheet-like, flexible articles, in particular envelopes, these being introduced on edge in stack form, into a station, particularly a station of a mail-processing machine, for further handling, having

- an essentially horizontal feed channel for receiving the stacks, which can be moved forward by a first conveying-belt arrangement, which is arranged in the feed channel;
- a discharge channel, which leads essentially upward from the end of the feed channel and in which there is provided a second conveying-belt arrangement, which acts on the respectively nearest articles of the stacks; and
- a separating or singularizing apparatus, which is likewise arranged in the discharge channel, extends in the direction of the base of the discharge channel and serves for imbricating the stream of articles which is conveyed upward by the stacks.

BACKGROUND OF THE INVENTION

A problem with such charging apparatuses is that, at the transition from the feed channel to the discharge channel, the sheet-like articles butt against one another in a very closely packed manner and are pressed against one another if the conveying-belt arrangement of the feed channel conveys articles up at a greater speed than the speed with which they are discharged by the conveying-belt arrangement in the discharge channel. This may result in irregular functioning of the separating device, such that the imbricated stream of discharged articles has irregularities and the separating result is not satisfactory. If the charging apparatus is a station of a mail-processing machine which is arranged upstream of an envelope-filling station, then the result may be, in the previously briefly described state of excessively close packing of envelopes in the transition region between the feed channel and the discharge channel, that the stream of envelopes conveyed upward in the discharge channel is subjected to irregular imbrication by the separating device to such an extent that individual envelopes are no longer conveyed up in the envelope-filling station, and this results in disruption to operation.

In order to avoid this disadvantage, an attempt has also already been made, in the feed channel, for the stacks of sheet-like articles which are to be conveyed forward to be moved by gravitational force rather than by a conveying-belt arrangement, for which purpose the feed channel has been oriented obliquely downward, with the result that the stacks of sheet-like articles, standing on edge, slid downward in the direction of the conveying-belt arrangement of the discharge channel. Such a charging apparatus is described in International Patent Application WO 99/08951.

In a fair number of cases, however, it may be expedient for the operation of moving a long stack or stacks of flat articles, which are introduced on edge, in the feed channel of a charging apparatus of the type under discussion here not to be rendered dependent on a certain gradient of the feed channel or on certain sliding properties of the articles, which are introduced on edge.

SUMMARY OF THE INVENTION

The object of the present invention is thus to configure a charging apparatus of the type defined in the introduction such that a uniform separating result is reliably achieved for the imbrication of the stream of upwardly-conveyed articles.

This object is achieved according to the invention in that, in the case of a charging apparatus having the features as have been defined in the introduction, provided at the transition of the feed channel to the discharge channel is a rib or sill which runs transversely to the conveying direction and, in relation to a vertical section in the conveying direction, takes such a cross-sectional course that articles which have crossed the rib or sill in the conveying direction by way of their bottom edge come into a position in which they are parallel, for example, to the conveying direction of the further conveying-belt arrangement, and are gripped one by one by the further conveying-belt arrangement such that in the region of the rib or sill, when the first conveying-belt arrangement is at a standstill or is running more slowly, a gap which is parallel to said rib or sill opens between the bottom edges of articles which are located in front of the rib or sill and the bottom edges of articles which have already passed the rib or sill, and in that installed at the transition of the feed channel into the discharge channel are a light transmitter and a light sensor for forming a light barrier which produces a detector signal which indicates the formation of said gap and can be supplied to a control apparatus for controlling a drive of the first conveying-belt arrangement.

If the charging apparatus is brought into operation, then one or more stacks of sheet-like articles which are to be introduced are positioned in the feed channel and the bottom edges of the sheet-like articles are supported on the first conveying-belt arrangement, which is located in the feed channel. The sheet-like articles also fill the feed channel in a closely packed manner in the region of the transition between the feed channel and the discharge channel. The light barrier, of which the detector light beam crosses over the channel width from one side of the transition region between the feed channel and discharge channel, remains obstructed by the stack of sheet-like articles which are to be conveyed, and the first conveying-belt arrangement, which is located in the feed channel, is brought to a standstill.

If the second conveying-belt arrangement, in the discharge channel, is then brought into operation, since sheet-like articles are required in the further handling station, for example in the envelope-filling station, then the second conveying-belt arrangement, which is located in the discharge channel, draws sheet-like articles upward past the separating device, and that part of the stack which is located in the transition region between the feed channel and the discharge channel is reduced in thickness. This then produces, in said transition region, a wedge-shaped gap through which the detector beam emitted by the light source can pass from one side of the channel to the other and come into contact with the light detector. This produces a light-barrier detector signal which brings the conveying-belt arrangement of the feed channel into operation and resumes the interspace-free or gap-free packing of the stack of sheet-like articles in the apparatus.

Advantageously, the light barrier does not respond to brief interruptions, and a certain time delay is provided between the interruption of the light barrier and the drive of the first conveying-belt arrangement of the feed channel being brought out of operation, it being possible for this time delay to be adjusted.

According to an advantageous modification, it is also possible for the detector signal of the light barrier to be used, in accordance with specific processing, to coordinate the respective conveying speeds of the conveying-belt arrangements in the feed channel and in the discharge channel with one another, with the result that more or less continuous operation is achieved.

BRIEF DESCRIPTION OF THE DRAWINGS

An exemplary embodiment is explained in more detail hereinbelow with reference to the drawing in which.

DISCLOSURE OF PREFERRED EMBODIMENT

Figure 1:
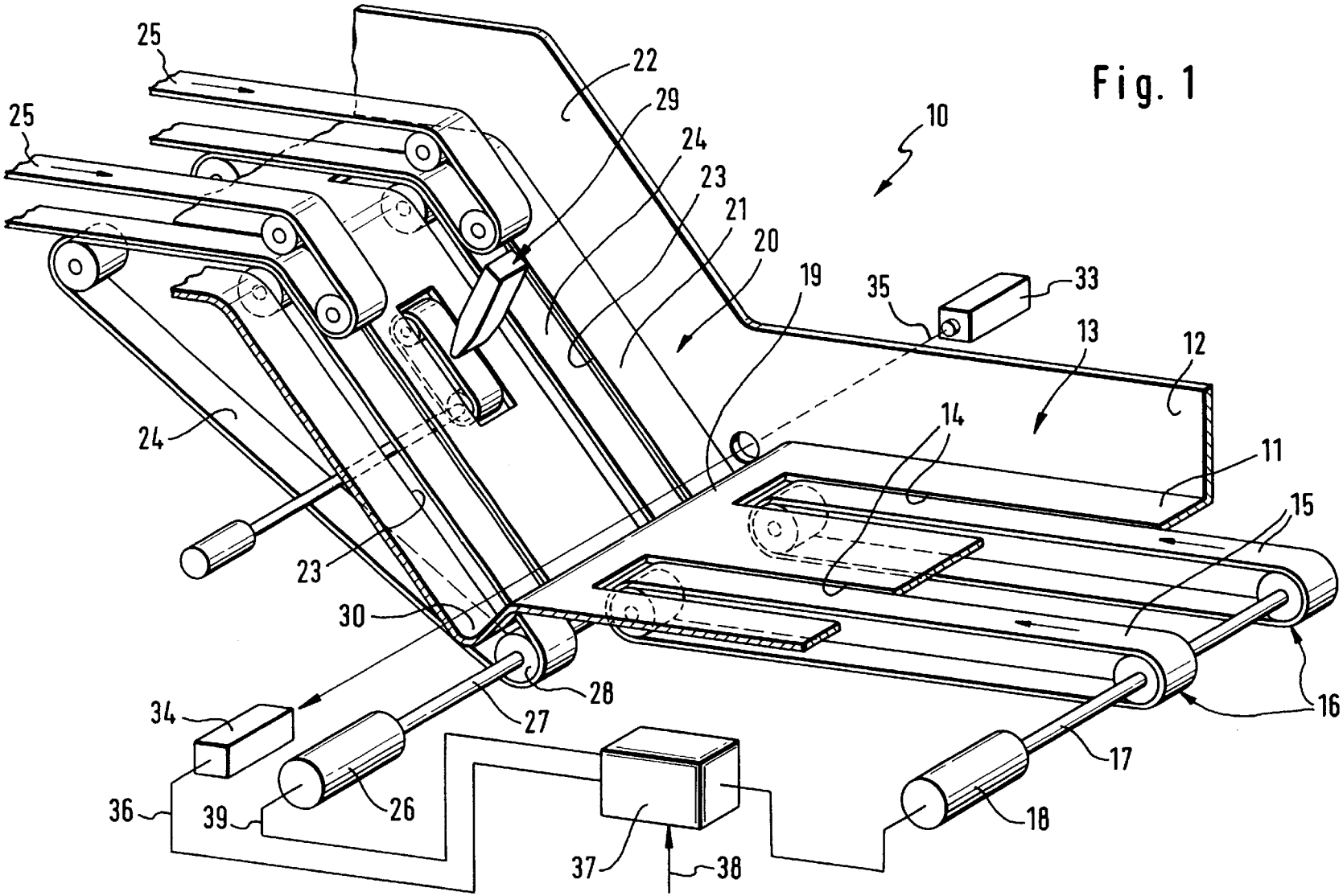
FIG. 1 shows a perspective view of a schematically illustrated charging apparatus of the type specified here, those parts which are not necessary for understanding the invention having been omitted.

The charging apparatus, which is designated in general terms by 10, contains a horizontal feed channel 13 which is bounded by a base 11 and side walls 12 of which only that side wall 12 which is remote from the individual looking at the drawing is shown in the figures. Longitudinally running slots 14 which are oriented in the conveying direction are provided in the base 11 of the feed channel 13. The respective top strand 15 of endless conveying belts 16, which are guided over rollers, projects beyond the level of the base 11 of the feed channel 13. The rollers which are depicted on the right-hand side in FIG. 1 are seated on a drive shaft 17, which is driven by means of a motor 18, with the result that the conveying belts 16 circulate in the direction of the arrows depicted on the top strands 15. In a modification to the embodiment shown, it is also possible for the base 11 of the feed channel 13 to be provided with cutouts in the region of the conveying-belt-supporting rollers, and for the top strands 15 otherwise to be guided over continuous regions of the base 11.

A discharge channel 20 leads obliquely upward from the end 19 of the feed channel 13. The discharge channel 20 also contains a base 21 and side walls 22, which bound the discharge channel 20 laterally. Once again, slots 23 run in the base 21 in the longitudinal direction of the discharge channel 20, and a respective section of endless circulating conveying belts 24 extend through said slots, the course taken by the conveying belts over associated rollers being easily recognizable from FIGS. 1 and 2. At the top end of the discharge channel 20, the base 21 of the latter merges into a horizontal section. The side walls 22 of the discharge channel also follow this horizontal course. The slots 23 of the base of the discharge channel continue into the horizontal section such that a horizontal section of each of the circulating conveying belts 24 can project through the slots beyond the level of the horizontal base section of the discharge channel.

It also applies to this part of the charging apparatus that, in a modification, it is possible for cutouts to be formed in the base 21 of the discharge channel 20 in the region of those rollers around which the conveying belts 24 are positioned, with the result that, in the sections therebetween, the conveying belts run over continuous surfaces of the discharge-channel base and are supported by the latter.

Figure 2:
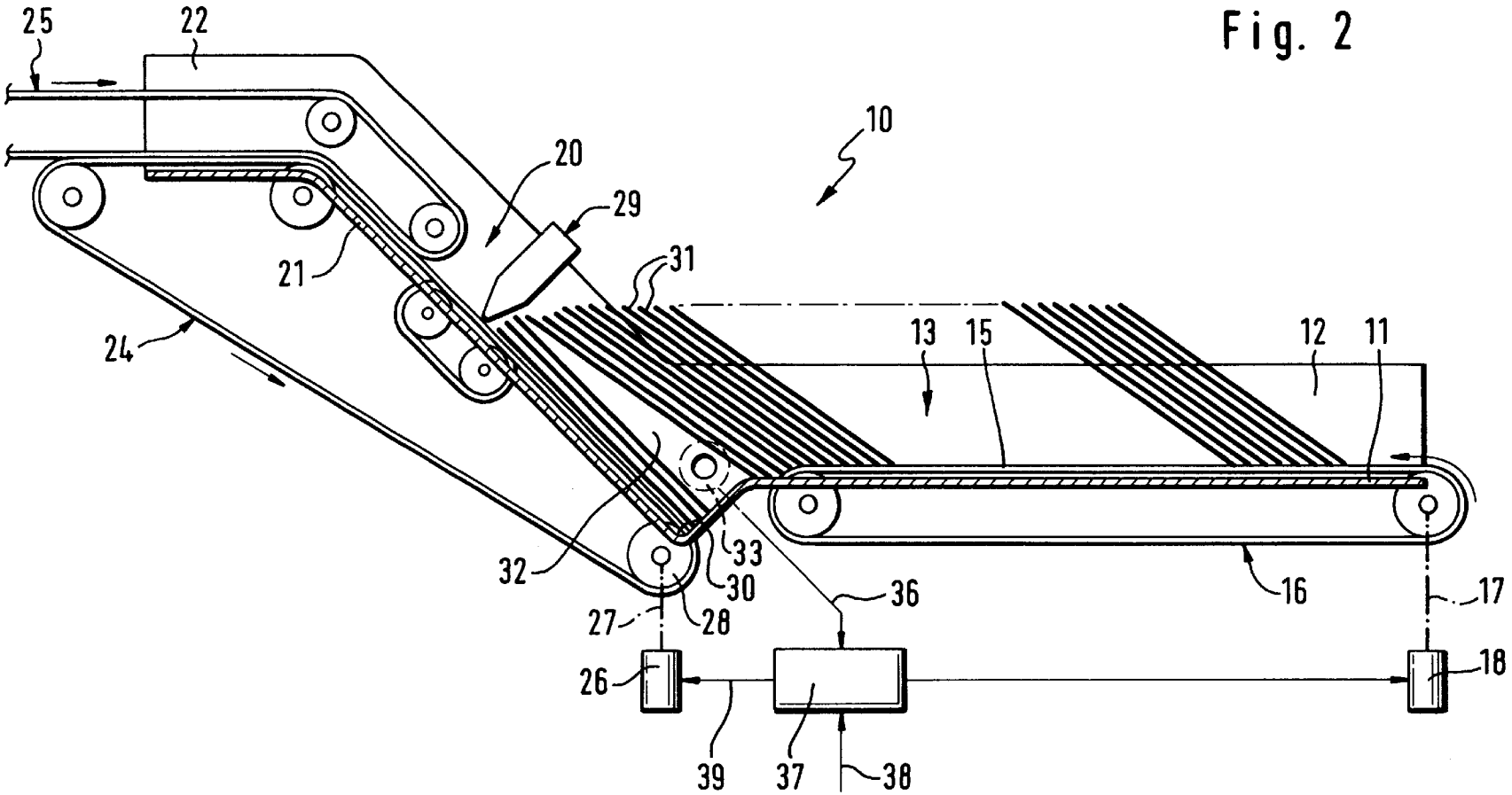
FIG. 2 shows a side view, depicted partially in section, of the apparatus of FIG. 1.

In each case one further conveying belt 25 is arranged opposite the horizontal section of the respective conveying belt 24 and the top part of that section of each conveying belt 24 which runs parallel to the base 21 of the discharge channel 20, and said further conveying belt is positioned over freewheeling rollers, of which those freewheeling rollers which are positioned in the vicinity of the right-hand end of the conveying belts 25 are shown in FIG. 1, whereas those freewheeling rollers which are positioned at the respective left-hand end of said conveying belts have been omitted in FIGS. 1 and 2.

The conveying-belt arrangement, which is formed from the conveying belts 24 and 25, is driven via a drive motor 26 and a common drive shaft 27 for the respectively bottom rollers 28 of the conveying belts 24. Only one of the rollers 28 can be seen in FIG. 1.

Located on the oblique section of the discharge channel 20 in the region beneath the ends of the conveying belts 25 is a separating device 29, which, in relation to a direction transverse to the conveying direction, is positioned between the conveying belts 24 in the discharge channel 20. Said separating apparatus 29 contains a stripper, of which the nose is directed onto an endless belt which has a smooth, low-friction, hard surface, is positioned over rollers and projects to some extent through a corresponding cutout of the base 21 of the discharge channel 20, it being possible for one of the rollers to be driven by means of a motor. This arrangement is recognizable to the person skilled in the art from FIGS. 1 and 2. The stripper of the separating apparatus 29 may be designed such that it can be adjusted both toward and away from the circulating belt serving as mating surface and also in the direction parallel to the conveying direction in the discharge channel 20. In order to simplify the illustration, however, details in this respect have been omitted from FIGS. 1 and 2. The abovedescribed possibilities for adjusting the stripper of the separating apparatus 29 serve, on the one hand, for adapting the device to different thicknesses of the sheet-like articles which are to be handled and, on the other hand, for adaptation to different formats of these articles.

At that end of the feed channel 13 which adjoins the discharge channel 20, the feed-channel base 11 has a sill via which the base 11 of the feed channel 13 slopes down to a depression 30, which merges into the base 21 of the discharge channel 20. In relation to a cross section corresponding to a vertical plane in the conveying direction, there is thus provided, in the course of the base 11 of the feed channel 13 and of the base 21 of the discharge channel 20, an undulating path or curved path which, as is shown in FIGS. 1 and 2, first of all slopes down from the level of the base 11 of the feed channel 13 and then rises to the base 21 of the discharge channel 20. In a modification to this, it is also possible to select a different undulating path or curved path of the cross section, for example in the form of a rib or of a two-sided ramp. In any case, the course of the bases 11 and 21 in their transition region is selected such that articles 31 which have crossed the rib or sill in the conveying direction by way of their bottom edge come into a position in which they are approximately parallel, for example, to the conveying direction of the conveying-belt arrangement comprising the conveying belts 24 and 25, and thus to the base 21 of the discharge channel 20, and are gripped one by one by the further conveying-belt arrangement, with the result that in the region of the rib or of the sill, when the conveying belts 16 are at a standstill, a gap 32 which is parallel to said rib or sill opens between the bottom edges of articles 31 which are located in front of the rib or sill and the bottom edges of articles which have already passed the rib or sill, and is only closed again, with the result that the articles 31 come to rest, in an essentially closely packed manner, over the entire length of the stack as far as the base 21 of the discharge channel 20, when the conveying belts 16 are brought into operation again. In the region of the transition between the base 11 of the feed channel 13 and the base 21 of the discharge channel 20, a light barrier is installed at the location where the abovementioned wedge-shaped gap 32 can form between parts of a stack of articles 31, said light barrier comprising a light source 33 on one side of the apparatus and a light sensor 34 on the opposite side of the apparatus. The light source 33 transmits a detector light beam 35, for example via through-passages in the side walls 12 and 22, to the light sensor 34, the detector light beam 35 crossing over the transition region between the feed channel 13 and the discharge channel 20, immediately following the sill or rib at the end of the base 11 of the feed channel 13, in a direction transverse to the conveying direction.

If a stack of articles 31 which initially all butt closely against one another is positioned in the feed channel 13, the articles being seated on the base 11 of the feed channel 13 by way of their bottom edge and also occupying the transition region between the base 11 and the base 21 in a closely packed manner, then the detector light beam 35 of the light barrier is interrupted and there is no detector signal passing from the light sensor 34, via a signal line 36, to a control apparatus 37, which is intended to switch the drive 18 for the conveying belts 16 on and off in dependence on said control signal. If there is thus no detector output signal from the light barrier on the line 36, then the drive 18 remains switched off. If however, in this state, it is indicated to the control apparatus 37 that articles which are to be handled are required in a handling station downstream of the present charging apparatus, for example in an envelope-filling station, then, via a signal line 39, the control apparatus 37 causes the drive motor 26 for the conveying belts 24 to be switched on, such that the conveying belts 24 begin to convey upward, in the discharge channel 20, one by one the articles which are nearest to them in each case, and to push said articles against the separating apparatus 29, which, by corresponding adjustment of its stripper, causes an imbricated stream of articles 31 which are to be handled to emerge downstream of the separating apparatus 29, over the base 21 of the discharge channel 20, to pass, by way of its leading end, between the conveying belts 24 and 25 of the conveying-belt arrangement assigned to the discharge channel, and to be moved on, between the horizontally running and mutually opposite sections of the conveying belts 24 and 25, in the direction of the further handling station. In such a handling station, it is possible for the imbricated stream of articles 31 which are to be handled to be converted into a series of individual articles 31 running one behind the other, for example by means of a cyclically operated gripper chain.

Since, however, the conveying belts 16 are at a standstill during this operation and the conveying-belt arrangement which is assigned to the discharge channel 20 draws out of the stack one after the other articles which are to be handled, the gap 32 which is depicted in FIG. 2 forms gradually, with the result that the detector light beam 35 of the light source 33 then passes to the light sensor 34 and a detector signal passes to the control apparatus 37 via the line 36. Said control apparatus then brings the drive 18 for the conveying belts 16 into operation, with the result that that part of the stack of articles 31 which was previously separated by the gap 32 from that part of the stack which butts against the base 21 of the discharge channel 20 is then guided up to the latter part of the stack again, as a result of which the gap 32 disappears, the detector light beam 35 is interrupted and the control apparatus 37 brings the drive 18 to a standstill again.

It should be expressly pointed out here that delay elements are expediently installed in the control apparatus 37, or else at some other suitable location in the circuit, these delay elements acting such that a very brief interruption of the light barrier does not immediately result in the conveying belts 16 being brought to a standstill, and that, once the light barrier is released on account of the formation of the gap 32, the drive 18 is kept in operation for a certain period of time, in order to allow stable operation of the control means.

It is also possible, within the scope of the design ideas specified here, for the conveying belts 16 and 24, 25 to be operated simultaneously over relatively long operating phases and, by corresponding intervention of the control apparatus 37, for the conveying speed of the conveying belts 16 to be increased when an excessively slow conveying speed of the conveying belts 16 results in the formation of the wedge-shaped gap 32 and the light barrier thus emits a detector signal via the line 36.

In this description and in the claims, a light barrier may also be understood as an arrangement in which the light source and the light sensor are arranged on one and the same side of the feed channel and of the discharge channel, while a reflector is located on the opposite side, with the result that the detector light beam has an autocollimation beam path.

It can be gathered that the charging apparatus specified here, on account of the only very slightly fluctuating stacking conditions in that part of the stack of articles 31 immediately in front of the separating apparatus 29, results in a more uniform imbricating result than has been possible hitherto, and that this uniformity of imbrication is not influenced either by a need for different handling stations, arranged downstream of the charging apparatus, and thus inevitably differently adjusted conveying speeds in the feed channel and in the discharge channel.

What is claimed is:

1. A charging apparatus for supplying sheet-like, flexible articles on edge in stack form into a station for further processing, said charging apparatus comprising:

(a) a substantially horizontal feed channel having a generally planar base for receiving stacks of flexible articles and a first conveying-belt arrangement arranged in the feed channel for conveying stacks on the base in a conveying direction;

(b) a discharge channel extending generally upwardly from the feed channel and a second conveying-belt arrangement in the discharge channel for acting on respectively nearest articles of a stack to convey a stream of the articles along the discharge channel;

(c) a separating apparatus arranged in the discharge channel and protruding toward the discharge channel for imbricating a stream of articles conveyed by the discharge channel;

(d) a sill positioned at a transition between the feed channel and the discharge channel transverse to the conveying direction, the sill extending lower than the plane of the base of the feed channel such that a gap forms within a stack between edges of the articles which have left the feed channel and edges of the articles remaining in the feed channel; and (e) installed at the transition of the feed channel to the discharge channel is a light barrier comprising a light source and a light sensor, the light barrier providing for transmission of a detector signal for indicating formation of the gap between edges of conveyed articles, proximate the sill, to a control apparatus for controlling the first conveying-belt arrangement.

2. The apparatus of claim 1, wherein the discharge channel leads obliquely upward, and wherein, the sill extends downwardly into a depression, in relation to a horizontal plane of the feed channel in the conveying direction.

3. The apparatus of claim 1, wherein the control apparatus also serves for controlling a drive for the second conveying-belt arrangement.

4. The apparatus of claim 2, wherein the control apparatus also serves for controlling a drive for the second conveying-belt arrangement.

5. The apparatus of claim 1, further comprising delay means for causing a drive for the first conveying-belt arrangement to be activated only after a relatively long interruption or when a gap in the articles is formed in a certain magnitude.

6. The apparatus of claim 2, further comprising delay means for causing a drive for the first conveying-belt arrangement to be activated only after a relatively long interruption or when a gap in the articles is formed in a certain magnitude.

7. The apparatus of claim 3, further comprising delay means for causing a drive for the first conveying-belt arrangement to be activated only after a relatively long interruption or when a gap in the articles is formed in a certain magnitude.

8. The apparatus of claim 4, further comprising delay means for causing a drive for the first conveying-belt arrangement to be activated only after a relatively long interruption or when a gap in the articles is formed in a certain magnitude.

* * * * *